United States Patent [19]

Hoff

[11] Patent Number: 4,811,944

[45] Date of Patent: Mar. 14, 1989

[54] ARM EXERCISER

[76] Inventor: Ross W. Hoff, 1240 Hollyview, Vermilion, Ohio 44089

[21] Appl. No.: 148,642

[22] Filed: Jan. 26, 1988

[51] Int. Cl.[4] ..... A63B 23/00

[52] U.S. Cl. ..... 272/67; 272/901; 272/143

[58] Field of Search ..... 272/901, 143, 117, 118, 272/67, 130

[56] References Cited

U.S. PATENT DOCUMENTS

| | | | |
|---|---|---|---|
| 3,294,399 | 12/1966 | Cugliari | 272/901 |
| 3,563,542 | 2/1971 | Wellman | 272/67 |
| 3,953,026 | 4/1976 | Stokely | 272/901 |
| 4,157,179 | 6/1979 | Ecklor, Jr. | 272/67 |
| 4,343,465 | 8/1982 | Allen | 272/67 |

*Primary Examiner*—Richard J. Apley
*Assistant Examiner*—J. Welsh
*Attorney, Agent, or Firm*—Gustalo Nunez

[57] ABSTRACT

An arm exercising apparatus for developing and strengthening a person's wrist and arm muscles such as the biceps, quadriceps, deltoids, triceps, etc. The apparatus is designed to closely duplicate the sport known as arm wrestling. The exercising apparatus includes a handle that is pivotally connected to a sleeve wherein said sleeve is slideably mounted over a rod. Said connection allows a twisting action of the wrist which closely duplicates those movements and forces actually experienced in arm wrestling and further allows the handle to be automatically adjusted at the proper height for the individual user. The above described sleeve and bar assembly is further connected to a rotatable pulley shaft, wherein said pulley shaft is designed to accept predetermined weights as selected by the user, the weights being the elements which provide the resistance required by the user. The arm exerciser may be attached to a table top or platform when in use.

2 Claims, 3 Drawing Sheets

ARM EXERCISER

BACKGROUND OF THE INVENTION

1. Field of the Invention

This invention is directed to an exercising apparatus for developing the muscles of the wrist, arm and chest, i.e. those muscles used primarily in arm wrestling.

2. Description of the Prior Art

The prior art is replete with various types of exercisers directed to developing arm, neck, chest and wrist muscles. It would appear that the majority of the exercisers utilize helical springs or elastic bands for providing the resistance required for the development of muscle. One such exercisers is U.S. Pat. No. 3,815,904 issued to Weiss, et al. which describes an exercising apparatus having two U-shaped hand grips which are connected to each other by a plurality of elastic closed bands, wherein the number of elastic bands determines the degree of resistance which is provided by the exercising device.

U.S. Pat. No. 3,947,025 to Hobby discloses an arm exercising device in which a helical spring provides the required resistance.

An example of an exercising device in which weights are used is shown in U.S. Pat. No. 4,068,843 issued to Frost. This exercisers is structurally complex and uses a table-mounted pivotally hinged arm which simulates an arm-wrestling opponent's arm.

SUMMARY OF THE INVENTION

The present invention is directed to an exercising apparatus of the type designed to exercise one's arm, and one which is ideal for home use and can also be used in gyms or the like. The instant invention uses weights to provide the required tension force which the user wants to overcome. However, the instant invention lends itself quite well to use of a fluid such as compressed air in conjunction with a pneumatic cylinder by which the desired force is applied to the pulley. The exercising apparatus is excellent for developing upper abdominals, lower abdominals, front quadriceps, anterior deltoid, triceps, biceps, etc.

Briefly, the exerciser is a pivotally mounted handle and arm assembly connected to a weight-bearing pulley assembly. The exerciser includes a handle which is pivotally connected to a sleeve member, wherein said sleeve member is telescopically mounted onto a rod member, wherein this rod member is pivotally connected to a second sleeve member. Continuing, said second sleeve member being connected to a second rod member, said second rod member being telescopically inserted into a bearing member and further connected to a rotatable pulley member, said pulley member having affixed to a pulley designed for receiving weights. The handle, as a result of the above-described connections, is automatically adjustable to any desired height without the need of physically making or changing any connections.

In use, the exercising apparatus is mounted to a stable surface and the pulley assembly is loaded with predetermined weights. The user grasps the handle and places his elbow on the stable surface at a point which lies generally along the longitudinal axis described by said bearing member. The user then moves the handle in a direction opposite the force generated by the weights and in a plane generally parallel to the plane described by the pulley assembly. This arm exerciser closely duplicates arm wrestling as actually experienced by arm wrestlers. The exercising apparatus contemplated here is simple in construction, is not mechanically complex and is economical to fabricate. It is also portable which is desirous for a person who travels and wants to keep physically fit.

DESCRIPTION OF THE PREFERRED EMBODIMENT

Figure 1:
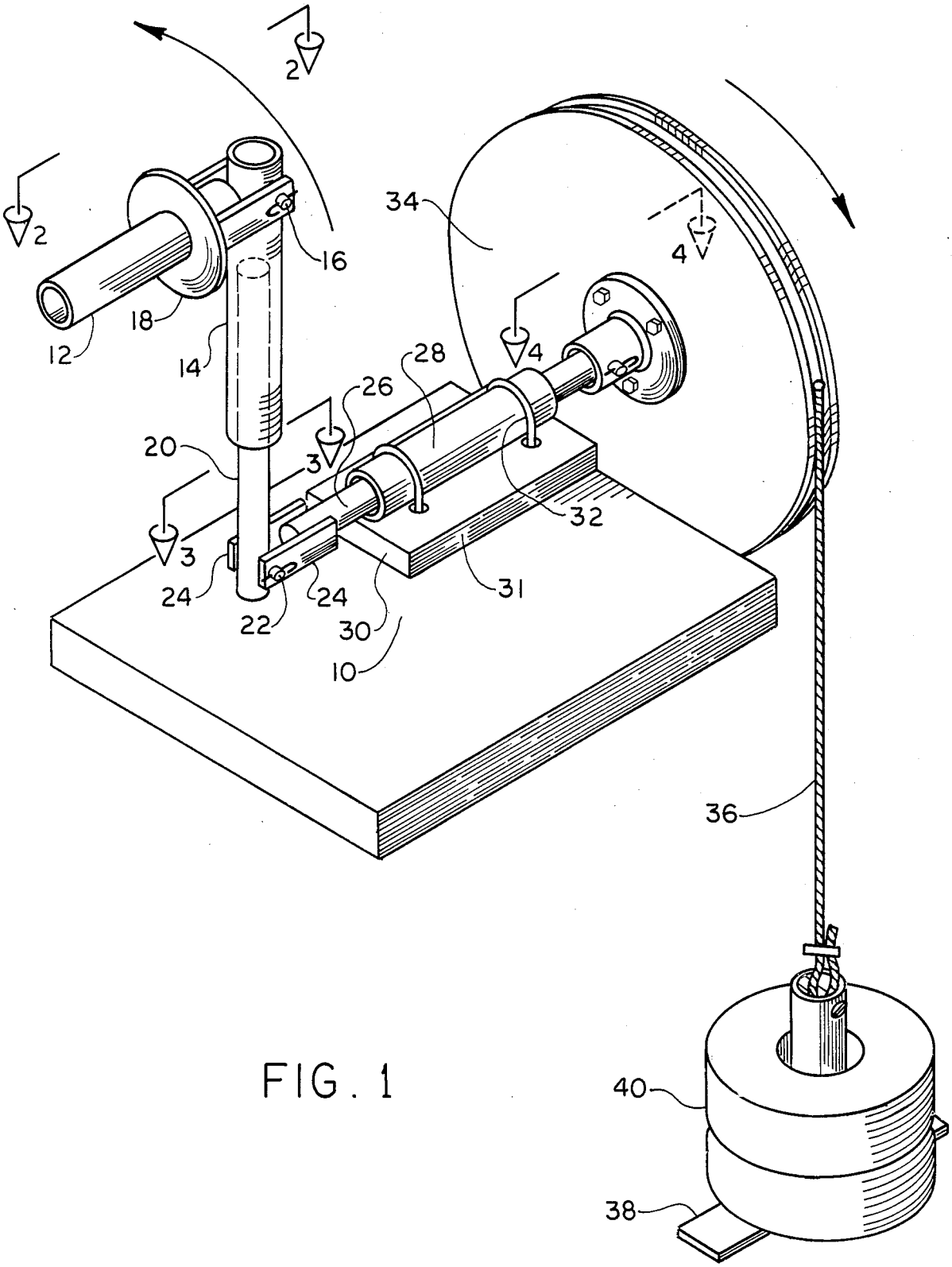
FIG. 1 is a perspective view of the exercising apparatus with the handle assembly in a down position.
Figure 2:
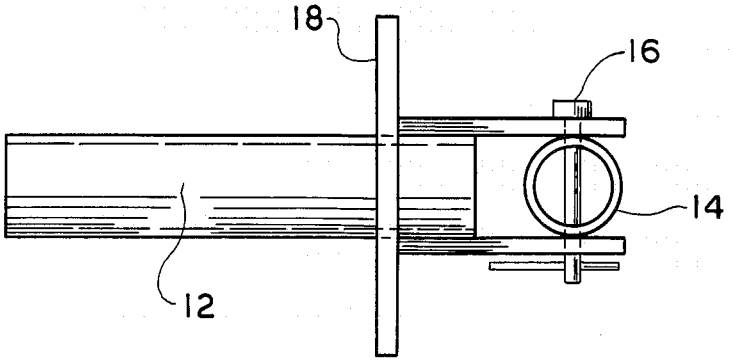
FIG. 2 is a top view of the handle assembly taken along lines 2—2 of FIG. 1.
Figure 3:
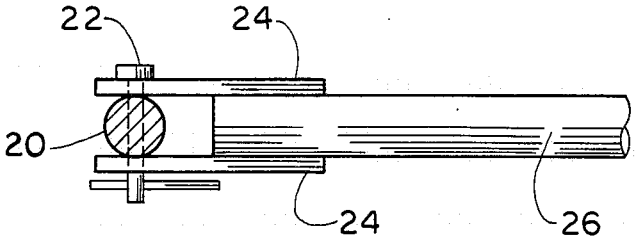
FIG. 3 is a view of the rod assembly taken along lines 3—3 of FIG. 1.
Figure 4:
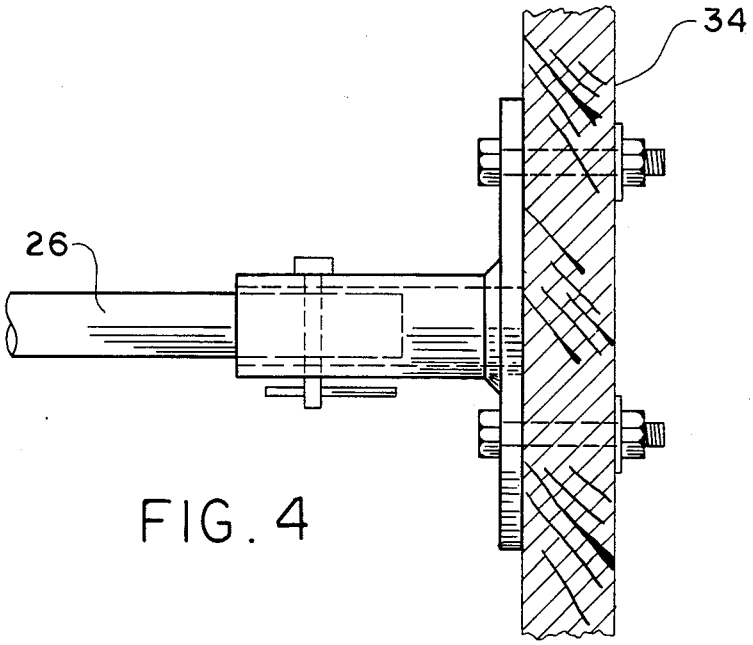
FIG. 4 is a view of the rod and pulley assembly taken along lines 4—4 of FIG. 1.
Figure 5:
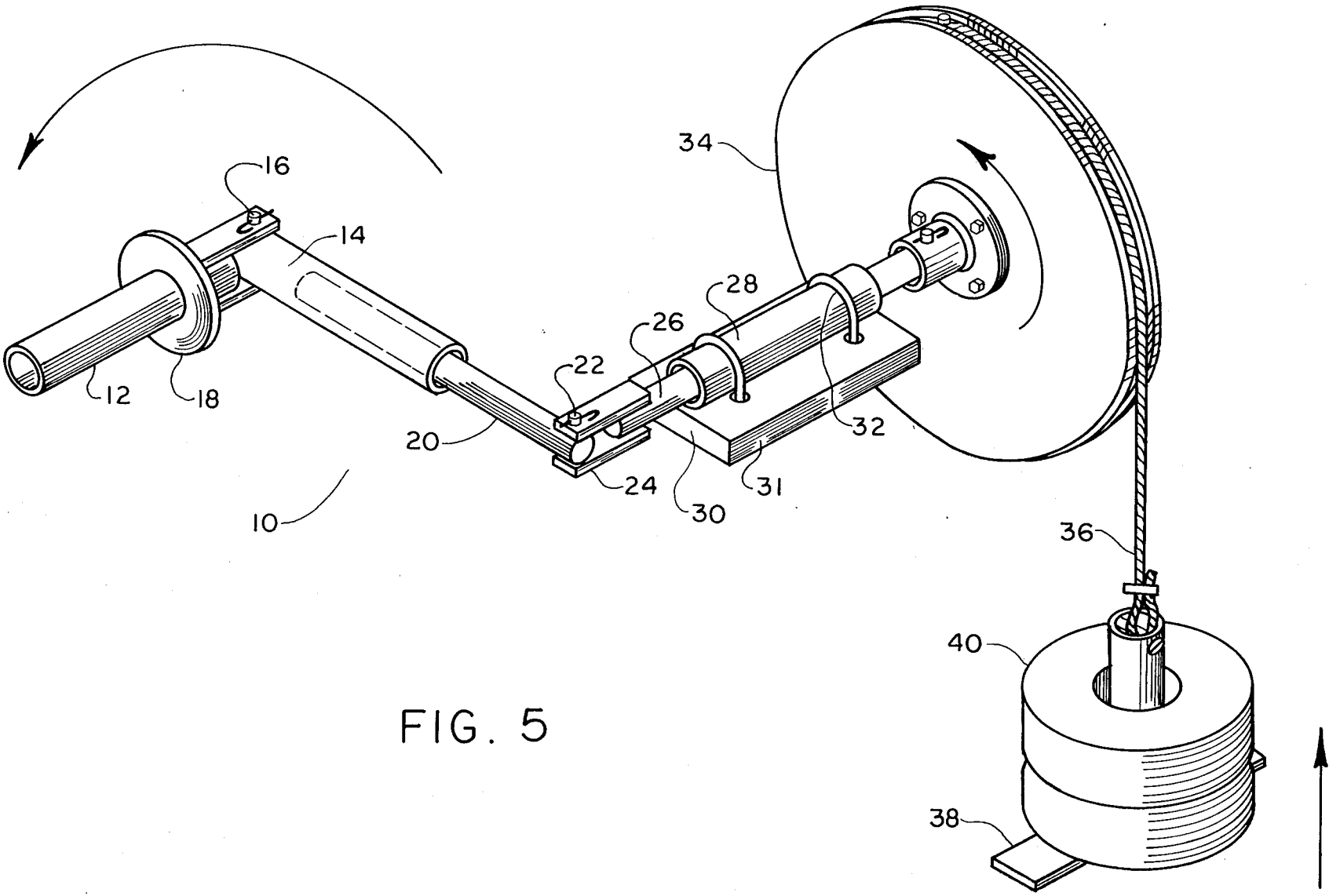
FIG. 5 is a perspective view of the exercising apparatus with the handle assembly in a down position.

The exercising apparatus to be further described in detail, as well as its objects and advantages over the prior art, may best be understood by reference to the following detailed disclosure and the drawings. It is understood, of course, that identical parts in the different figures are referred to by the same reference numeral.

Referring now to the drawings, the preferred embodiment is shown generally by the reference numeral 10. The exercising apparatus 10 includes a handle 12 which is pivotally connected to a first sleeve member 14 at pivot point 16. The connection at pivot point 16 may be made by any conventional means such as an axle or conventional bolt member. The handle 12 also includes a handguard 18, the use of which shall be explained later. The handguard 18 may be a steel washer or a plastic spacer. Similarly, the handle 12 and other parts of the exercising device may be fabricated from any material having the tensile and compression strength necessary to overcome fatigue which will be impressed on the exercising apparatus 10 by the forces which are imposed when the exercising apparatus 10 is in use. Other representative materials from which the exercising apparatus may be fabricated would be aluminum and steel alloys.

Continuing, the sleeve 14 is telescopically mounted onto a first rod member 20, said rod member 20 being pivotally connected, by conventional means, at pivot point 22 to a second sleeve member 24. The sleeve member 24 is connected to a second rod member 26 by conventional and well-known means such as a weld connection. The second rod member 26 is telescopically inserted into a bearing member 28; thus, the second rod member 26 is capable of rotational movement about a pivot point described by the longitudinal axis of said bearing member 28. The above described assembly is mounted to a stable surface such as a table or bench top by conventional means such as C-clamps, screws, bolts or U-bolts. In the embodiment shown, the exercising apparatus is shown connected to a surface 30 by conventional U-bolts 32. In order that the rotational movement of the handle assembly not be impeded by the surface 30, it may be necessary to utilize a spacer 31 which is placed between the bearing member 28 and the surface member 30. Although the sleeve member 14 is shown as a pair of parallel arms, they could easily be fabricated from cylindrical stock terminating in a U-shaped configuration.

Referring again to FIG. 1, it can be seen that the second rod member 26 extends beyond one end of the bearing 28 and also extends beyond to the edge of surface 30. The terminating end of the second rod member 26, which would extend beyond the edge of the surface used, is connected to a pulley 34. Again the connection may be a threaded one, a welded or compression connection, or may be connected by means such as a key. A cable member 36 at one end is attached to the pulley by conventional means such as a screw, and at its other end is attached to a T-shaped member 38. T-shaped member 38 may be permanently connected to the cable 36 or removably connected. The type of connection is determined by the types of weights which are to be loaded onto cable 36, eg. in the event the connection is permanent, the weights used would have to include a slot for placing the weights onto the cable 36 and T-shaped member 38. In the event the connection is removable, the weights simply would need an opening for insertion of the T-shaped member 38.

The manner in which the exercising apparatus is utilized can now be described. Referring again to FIG. 1, the user would grip the handle 10 by placing his hand up to the hand guard 18, which prevents the user's hand from sliding, and would place his elbow at a point generally lying on an axis described by the bearing member 28. The elbow must be placed at a distance from the exercising apparatus 10 such that the user can comfortably grip the handle 12 and impose a rotational force to the pulley 34. Initially, the sleeve and rod members 14 and 20 will be in a position perpendicular to the surface member 30. The weights 40 will impose a rotational force on the handle assembly 12 and sleeve and rod assembly 14 and 20 in a direction facing the viewer of FIG. 1 as shown by the arrow adjacent the pulley 34. The user, while gripping the handle 12 will attempt to impose a rotational force in a direction opposing the force developed by the weight 40 and will, when the force imposed by the user overcomes the force developed by the weights 40, move the handle 12 down to a position generally parallel to the surface being used. As a result of the telescopic connection between the sleeve 14 and the rod 20, and the pivotal connection of the handle 12 at 16, the user experiences forces on his arm, wrist and hand that he would experience had he actually arm wrestled with another person, there being one exception. When arm wrestling with an opponent the forces each uses against the other will not be uniform, i.e. it depends on the physical stamina of the person such that an arm wrestler may attempt to overcome his opponent by exercising bursts of force. The exercising apparatus 10 as described exerts a uniform force throughout. This is the optimum condition for developing stamina and strength in the hand, wrist and arm.

However, because of the versatility and non-complexity of the exercising apparatus 10, it can be designed to function in a manner such that the user would experience uneven bursts of force such as one would experience in actual arm wrestling. One embodiment of such an exercising apparatus would be to connect the cable 36 to a conventional pneumatic cylinder. The pneumatic cylinder can be set at a predetermined force or the valve controlling the fluid, e.g. compressed air, can be programmed to change the force in a positive or negative direction by a certain percentage or percentages thus generating uneven bursts of forces which must be overcome.

The exercising apparatus 10 may be used in various positions such as prone, standing or sitting positions. However, it is suggested that the sitting position is best. The telescopic connection of the sleeve 14 to the rod 20 permits the automatic adjustment of the handle 12 to whatever height is required by the user.

The exercising apparatus 10 may be used by left-handed persons or right-handed persons, the only adjustment required being to reverse the direction of the cable 36 on the pulley 34.

While a preferred embodiment has been disclosed, it will be apparent to those of ordinary skill in the art, upon reading this disclosure, that other modifications and variations can be made. Accordingly, reference should be made to the appended claims for determining the full and complete scope of the present invention.

What I claim is:

1. An arm exercising apparatus comprising:

an elongated handle member including a hand guard and terminating at one end in a U-shape configuration, said U-shaped end including a pair of apertures in axial alignment with respect to each other;

a first elongated cylindrical sleeve member including an opening throughout its longitudinal axis, said first elongated sleeve member including a pair of apertures in opposite relationship and in axial alignment with respect to each other;

means for pivotally connecting said handle to said sleeve at a point defined by the alignment of apertures of said handle member and said first elongated sleeve member;

a first elongated rod member adapted to the telescopically inserted into said first elongated sleeve member whereby said first sleeve member is free to rotate about or move up and down along said first rod member while in use, said first rod member including an aperture therethrough at one end thereof;

a second sleeve member terminating at one end thereof in a U-shaped configuration, said U-shaped terminating end including a pair of apertures oppositely disposed and in axial alignment with respect to each other;

means for pivotally connecting said second sleeve member to said first rod member, at a point defined by the apertures located on said first rod member and said second sleeve member;

a generally elongated second rod member;

means for connecting said elongated rod member to said second sleeve member;

an elongated bearing member, adapted to rotatably receive said elongated second rod member;

a pulley member;

means for connecting said pulley member to said elongated second rod member; and, means for attaching load means to said pulley member.

2. An arm exercising apparatus comprising:

an elongated handle member including a hand guard, a pair of oppositely disposed apertures in alignment with respect to each other, located at an end closest to said handguard;

an elongated first cylindrical sleeve member, terminating at one end thereof with a pair of oppositely disposed apertures in alignment with respect to each other;

means for pivotally connecting said handle member to said first cylindrical sleeve member, a pivot point being defined by the apertures of said handle member and said first cylindrical sleeve member;

a first rod member adapted to be telescopically recieved by said first cylindrical sleeve member, whereby said first sleeve member is free to rotate about or move up and down along said first rod member while in use, said first rod member including an aperture at one end thereof, said aperture positioned in a plane generally described by said apertures located on said first cylindrical sleeve member;

a plurality of extending arm members having at one end thereof, a pair of apertures;

means for pivotally connecting said first rod member to said extending arm members, said apertures located on said first rod member and on said extending arm members, defining a pivot point for the connection between said first rod member and said extending arm members;

a generally elongated second rod member;

means for connecting said elongated second rod member to said extending arm members;

a bearing member adapted to rotatably receive said elongated rod member;

a pulley member;

a cable element mounted on said pulley member; and, means for attaching weights to said cable element.

* * * * *